US005466021A

United States Patent [19]

Ishihara et al.

[11] Patent Number: 5,466,021

[45] Date of Patent: Nov. 14, 1995

[54] DOOR CLOSING DEVICE

[75] Inventors: Hiroshi Ishihara; Yoshinobu Ogura, both of Kariya, Japan

[73] Assignee: Aisin Seiki Kabushiki Kaisha, Kariya, Japan

[21] Appl. No.: 99,666

[22] Filed: Jul. 30, 1993

[30] Foreign Application Priority Data

Jul. 30, 1992 [JP] Japan ..... 4-204098
Sep. 14, 1992 [JP] Japan ..... 4-244967

[51] Int. Cl.[6] ..... E05C 3/06

[52] U.S. Cl. ..... 292/201; 292/341.16; 292/DIG. 23

[58] Field of Search ..... 292/201, 216, 292/DIG. 23, DIG. 65, DIG. 43, 341.16, DIG. 25, 341.12

[56] References Cited

U.S. PATENT DOCUMENTS 4,624,491 11/1986 Vincent ..... 292/201
4,703,960 11/1987 Lense ..... 292/201 X
4,979,384 12/1990 Malesko et al. ..... 292/216 X
4,986,579 1/1991 Ishikawa ..... 292/201
5,180,198 1/1993 Nakamura et al. ..... 292/201
5,232,253 8/1993 Tamiya ..... 292/DIG. 43 X

FOREIGN PATENT DOCUMENTS 496693 4/1930 Germany ..... 292/341.16
1187949 2/1965 Germany ..... 292/DIG. 23
3725075 8/1988 Germany .
59-65165 5/1984 Japan ..... 292/341.16
64-36881 2/1989 Japan .

*Primary Examiner*—Rodney M. Lindsey
*Attorney, Agent, or Firm*—Burns, Doane, Swecker & Mathis

[57] ABSTRACT

A door closing device comprises a door-lock mechanism provided between a door and a body and including a striker secured to the body and a latch member provided on the door, a driving mechanism, and a door-closing mechanism for establishing a perfect closed condition of the door relative to the body when the striker is in receipt of a groove of the latch member. The door-closing mechanism includes a passive-lever adapted to be moved in a linear mode by the driving mechanism in order to be brought into engagement with the latch member.

9 Claims, 9 Drawing Sheets

DOOR CLOSING DEVICE

BACKGROUND OF THE INVENTION

1. Field of the Invention

The present invention relates to a door closing device and in particular to a door closing device for bringing a door which is in an imperfectly closed condition into a perfectly closed condition.

2. Description of the Prior Art

U.S. Pat. No. 4,986,579 granted to Ishikawa on Jan. 22, 1991, discloses a door closing device which, in order to bring a door from an imperfectly closed condition into a perfectly closed condition, includes a door-closing mechanism associated with a door-lock mechanism. The door-closing mechanism has an active-lever which is adapted to be rotated, and a passive-lever which is operatively connected to the door lock mechanism. The rotation of the active-lever is transmitted to the passive-lever via a pin disposed therebetween, thereby resulting in rotation of the passive-lever. In that way, the door-lock mechanism is actuated to cause the door to be brought into the perfectly closed condition. In the foregoing structure, when the rotating passive-lever is brought into engagement with a latch member, the rotation of the passive-lever is adapted to actuate the door-lock device in order to establish the perfectly or fully closed condition of the door.

In the foregoing structure, the plane of rotation of the passive-lever and the plane of rotation of the latch member make an angle of about 90 degrees with each other. This means that when the passive-lever and the latch member are engaged while under rotational movement, a sliding friction will be generated along two directions. Thus, a loss is generated in the transmission of torque from the passive-lever to the latch member.

SUMMARY OF THE INVENTION

It is, therefore, an object of the present invention to provide a door closing device without the foregoing drawback.

It is another object of the present invention to provide a door closing device in which a loss is eliminated in the transmission of torque from the passive-lever to the latch member.

In order to achieve these objects, there is provided a door closing device that comprises a door-lock mechanism which is provided between a door and a body and which includes a striker secured to the body and a latch member provided on the door, a driving mechanism, and a door-closing mechanism for establishing a perfectly closed condition of the door relative to the body when the striker is received in a groove of the latch member. The door-closing mechanism includes a passive-lever adapted to be moved in a linear mode by the driving mechanism in order to be brought into engagement with the latch member.

BRIEF DESCRIPTION OF THE DRAWINGS

Additional objects and advantages of the present invention will become more apparent from the following detailed description of the preferred embodiments when considered with reference to the attached drawings, in which.

DETAILED DESCRIPTION OF THE INVENTION

Figure 1:
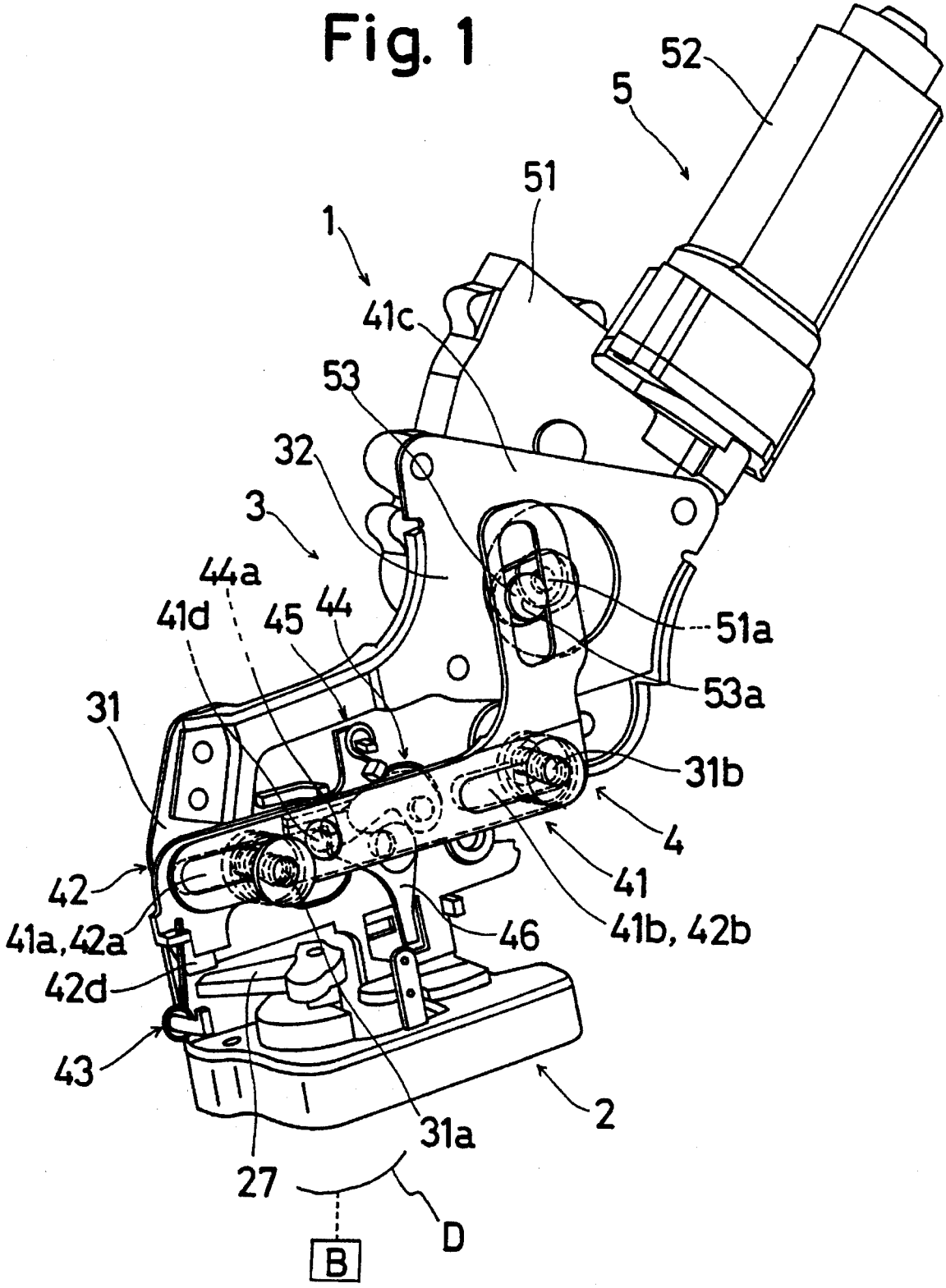
FIG. 1 is a perspective view of a door closing device in accordance with the present invention.

Referring to FIG. 1, a door closing device 1 includes a door-lock mechanism 2 accommodated in a door D of a vehicle body B, a supporting member 3 having a pair of adjacent brackets 31 and 32, a closing mechanism 4 mounted on the supporting member 3 which is associated with the door-lock mechanism 2, and a driving mechanism 5 which is associated with the closing mechanism 4.

Figure 2:
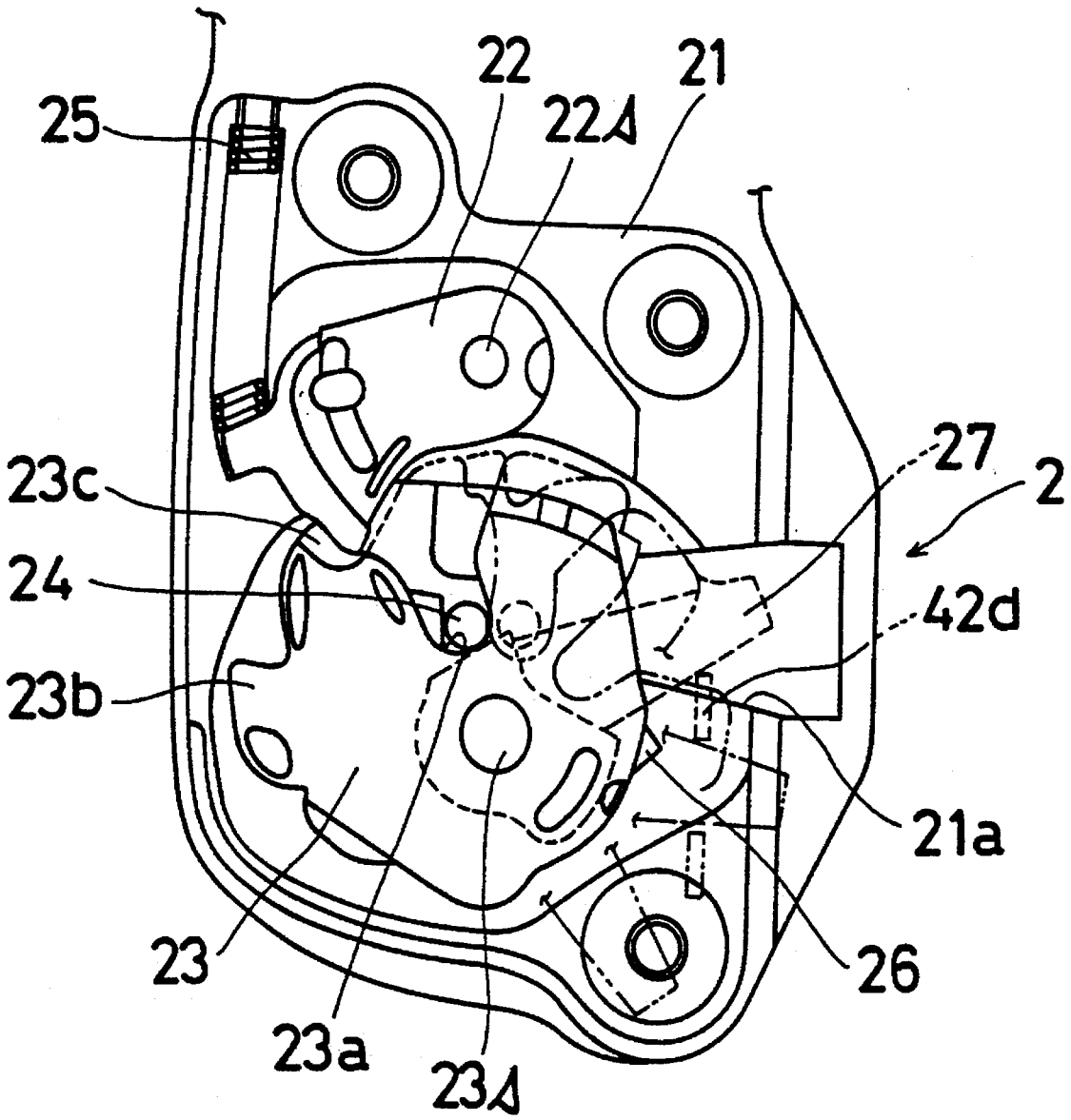
FIG. 2 is a plan view of a door lock mechanism of the device shown in FIG. 1.

The door-lock mechanism 2, which is best shown in FIG. 2, has a casing 21 in which a pawl 22 and a latch member 23 are rotatably mounted on a pawl shaft 22*s* and a latch shaft 23*s*, respectively. The latch member 23 is provided with two projections 23*b*, 23*c* and a groove 23*a* which is adapted to be brought into engagement with a striker 24. Each of the projections 23*b* and 23*c* is adapted to be engaged with the pawl 22 when the striker 24 is in engagement with the groove 23*a*. The striker 24 is secured to the vehicle body B and is adapted to be moved along a groove 21*a* in the casing 21 during the closing movement of the door D. The pawl 22 is continually urged by a spring 25 so as to be engaged with one of the projections 23*b* and 23*c* of the latch member 23. The latch member 23 is continually urged by a spring 26 so as to be moved away from the striker 24. The latch-lever 27 is adapted to be positioned in a full-latched position, a half-latched position, and an unlatched position in this order in the clockwise direction shown in FIG. 2.

When the projection 23*b* is engaged with the pawl 22, the latch member 23 is prevented from being rotated, thereby maintaining the door D in the half-latched condition. When the projection 23*c* is engaged with the pawl 22, the latch member 23 is also prevented from being rotated, thereby maintaining the door D in the full-latched condition. Moreover, in a well-known manner, the pawl 22 is operatively connected to an inside door handle (not shown) and an outside door handle (not shown), both of which are used for opening the door D. The pawl 22 is also operatively associated with an open-lever (not shown) which is adapted to rotate the pawl 22 in order to move the pawl 22 away from the projections 23*b* or 23*c*. The latch shaft 23*s* extends outwardly and a distal end portion of the latch shaft 23*s* is secured to the latch-lever 27 so as to be rotated in unison therewith. The latch-lever 27 is in operative association with the closing mechanism 4 as will be detailed later. It is to be noted that the closing movement of the door D is adapted to be established by pushing the door D toward the vehicle body B.

Figure 3:
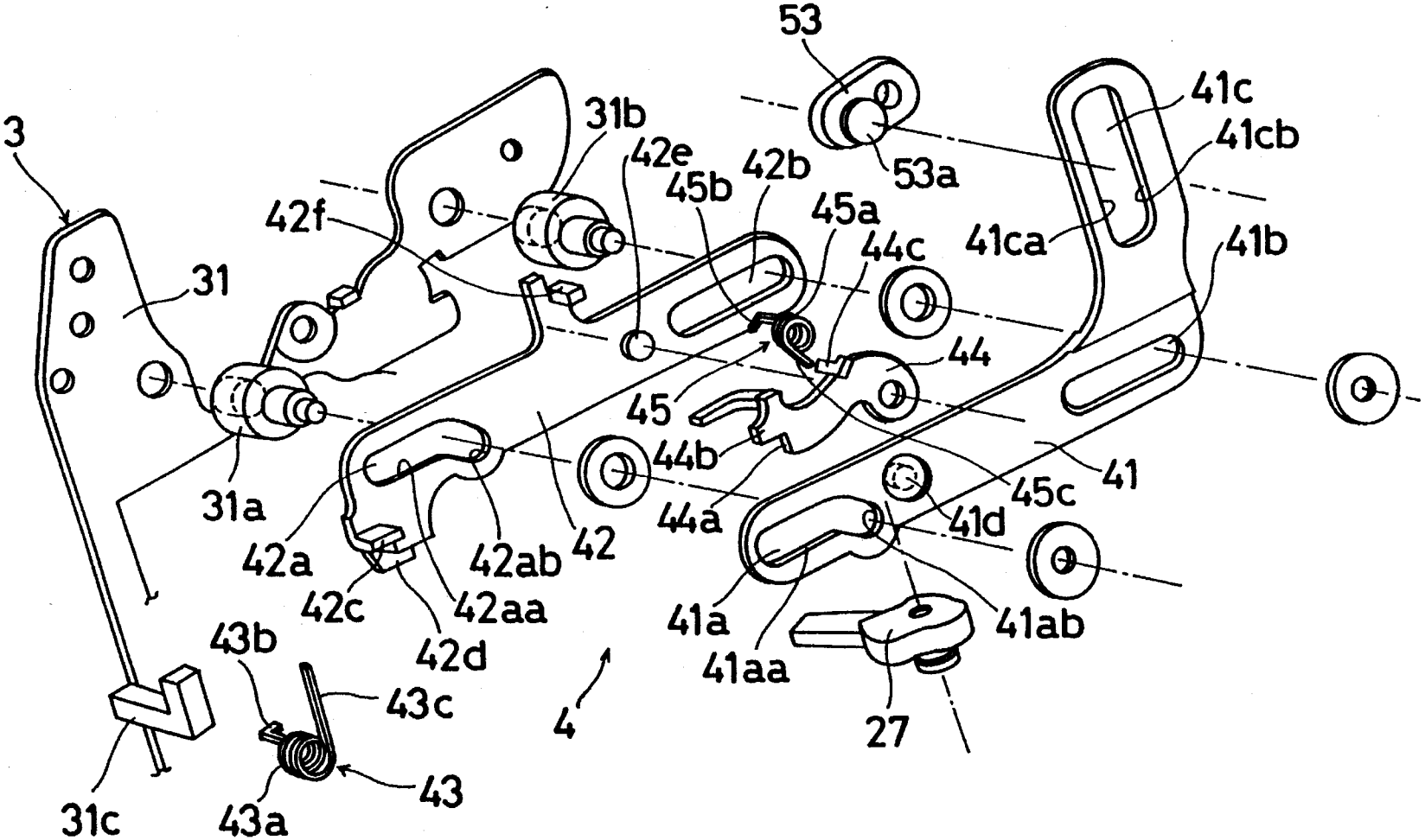
FIG. 3 is an exploded perspective view of a closing mechanism of the device shown in FIG. 1.
Figure 4:
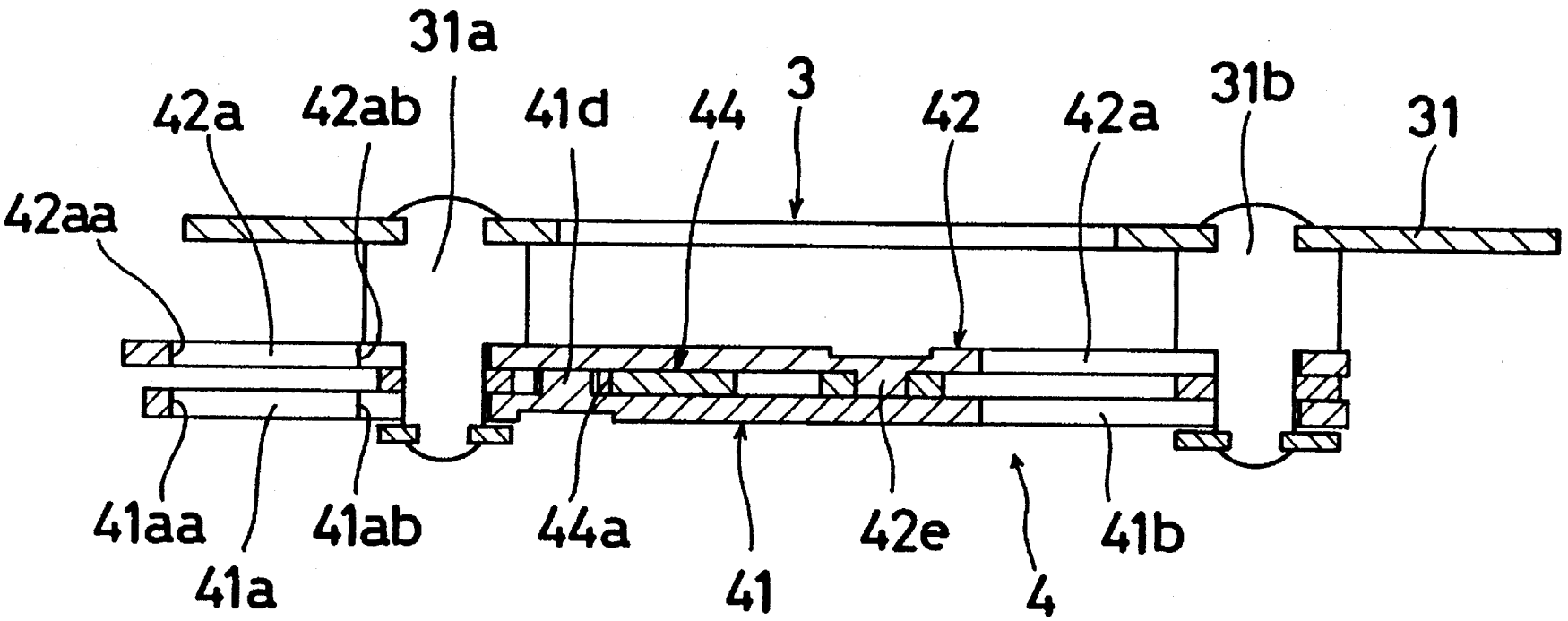
FIG. 4 is a horizontal cross-sectional view of the closing mechanism shown in FIG. 3.

The closing mechanism 4 will be detailed with reference to FIGS. 1, 3, and 4. On the casing 21, there is secured a bracket 31 which has a substantially L-shape. The bracket 31 is provided with a set of spaced support shafts 31*a* and 31*b*. The support shaft 31*a* is in sliding engagement with a slot 41*a* of an active-lever 41 and a slot 42*a* of a passive-lever 42. The support shaft 31*b* is in sliding engagement with a slot 41*b* of the active-lever 41 and a slot 42*b* of the passive-lever 42. The slots 41*a*, 42*a* (41*b*, 42*b*) are identical or substantially identical in shape, width, and length. Thus, the active-lever 41 and the passive-lever 42 are movable within a distance defined by each of the slots.

The slot 41*a* (42*a*) has a horizontal portion 41*aa* (42*aa*) which establishes a horizontally straight line of movement of the active-lever 41 (the passive-lever 42) and an inclined portion 41*ab* (42*ab*) which establishes a rotation of the active-lever 41 (the passive-lever 42) through an angle. The active-lever 41 is provided with a slot 41*c* which is operatively associated with the driving mechanism 5 which will be described in more detail below.

Figure 8:
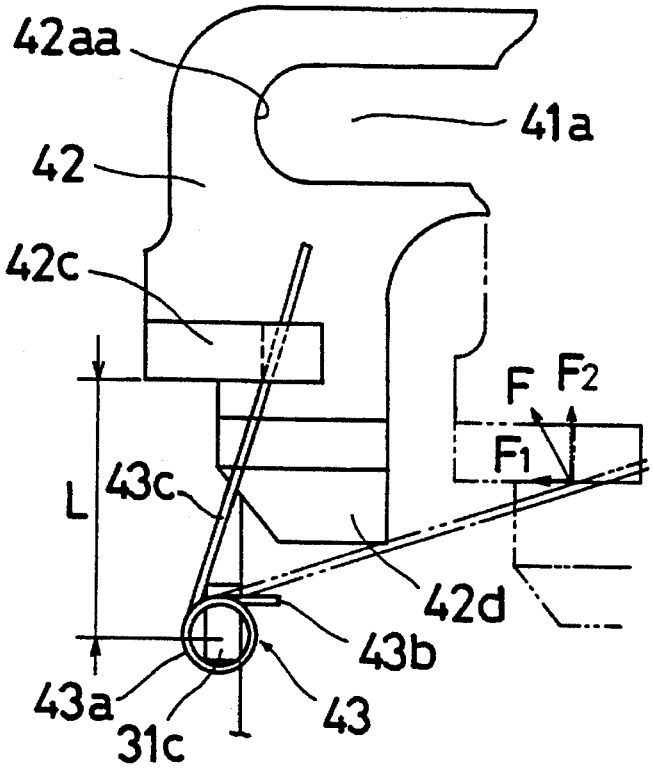
FIG. 8 is an enlarged side view of a portion of the device shown in FIG. 1 illustrating one embodiment of a torsion spring used in the closing mechanism.

The passive-lever 42 is provided with an engaging portion 42*d* which is engagable with the latch-lever 27 and which is perpendicular to a rotating portion of the latch-lever 27. A torsion spring 43 is disposed between the bracket 31 and the passive-lever 42 in such a manner that a winding portion 43*a* of the torsion spring 43 is mounted on a hook portion 31*c* of the bracket 31. One end portion 43*b* of the torsion spring 43 engages the bracket 31, and the other end portion 43*c* of the torsion spring 43 engages a projection 42*c* of the passive-lever 42. The passive-lever 42 is rotated in the leftward direction in FIG. 1, by which the passive-lever 42 is kept at its initial position or the illustrated position in FIG. 1, so that the support shaft 31*a* is located in both of the inclined portions 41*ab*, 42*ab*, and the support shaft 31*b* is disposed in the rightmost portion of each of the slots 42*a*, 42*b* of the passive-lever 42. The torsion spring 43 maintains the passive-lever 42 at its original position. As shown in FIG. 8, a span L between the engaging portion 42*c* and the engaging portion 31*c* can be reduced in comparison with the conventional devices.

A projection shaft 42*e* which is oriented toward the active-lever 41 is formed on the passive-lever 42 by pressing (i.e., is press-formed). A cancel-lever 44 is rotatably mounted on the projection shaft 42*e* such that the cancel-lever 44 is disposed between the active-lever 41 and the passive-lever 42. At a distal end portion of the cancel-lever 44, there are formed a pressing wall 44*a* and a regulating wall 44*b*.

The active-lever 41 is provided with a press-formed projection 41*d* which is oriented toward the passive-lever 42 so as to be engaged with and disengaged from both the pressing wall 44*a* and the regulating wall 44*b* when the cancel-lever 44 is rotated. The cancel-lever 44 is operatively connected to the open-lever (not shown) via a lever 46 (FIG. 1). A torsion spring 45 is disposed between the passive-lever 42 and the cancel-lever 44 in such a manner that a winding portion 45*a* of the spring 45 is mounted on a projection 42*f* of the passive-lever 42. One end portion of the spring 45 is engaged with a projection 42*f* of the passive-lever 42, and the other end portion of the spring 45 is engaged with a projection 44*c* of the cancel-lever 44. The torsion spring 43 urges the cancel-lever 44 in the counter-clockwise direction in FIG. 1 so as to maintain a locked condition under which the projection 41*d* engages both the pressing wall 44*a* and the regulating wall 44*b*.

Referring back to FIG. 1, the driving mechanism 5 has a reducer 51 which is in the form of a combination of several gears (not shown). The reducer 51 is secured to the bracket 32 which is fixed to the bracket 31. An input shaft (not shown) of the reducer 51 is connected to a motor 52, and an output shaft 51*a* of the reducer 51 is secured with a cam lever 53. The cam lever 53 has a cam shaft 53*a* which, upon rotation thereof, is adapted to be brought into engagement with a side wall 41*ca* or a side wall 41*cb* of the slot 41*c* of the active-lever 41.

Figure 5:
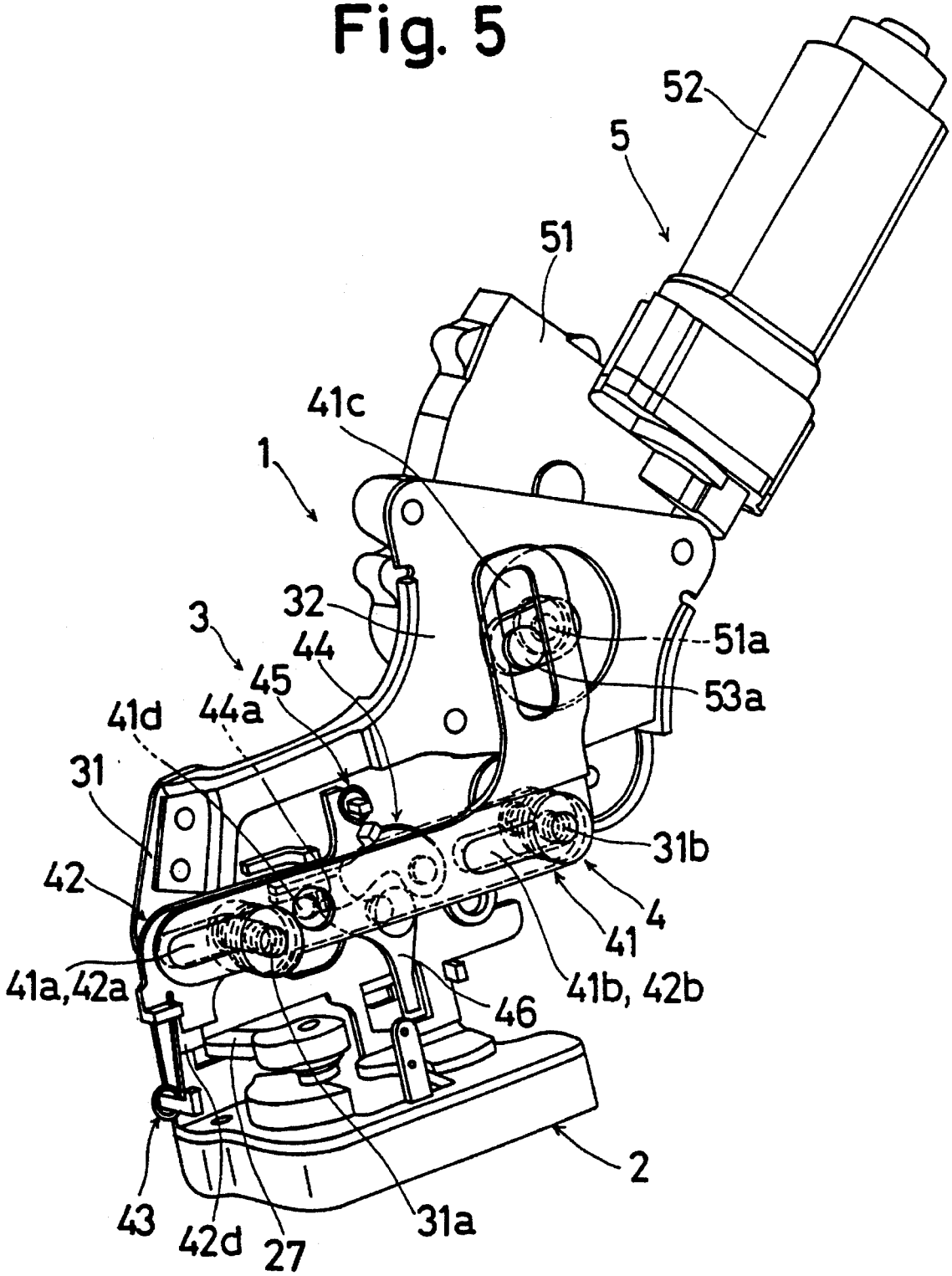
FIG. 5 is a perspective view of the device shown in FIG. 1 wherein a door is brought into a half-latched condition by the locking mechanism.

In operation, when the door D is moved toward the closed position, the striker 24 moves along the groove 21*a* of the casing 21 and is engaged with the groove 23*a* of the latch member 23, which results in rotation of the latch member 23. Thus, the door is brought into the half-latched condition. At this time, the latch-lever 27 is also rotated and is transferred to the position shown in FIG. 5. During transfer of the latch lever 27 from the position shown in FIG. 1 to the position shown in FIG. 5, the engaging portion 42*d* of the passive-lever 42 is offset from the locus of the rotation of the latch-lever 27 (i.e., from the plane of rotation of the latch-lever 27) due to the fact that the supporting shaft 31*a* is in the inclined portion 42*ab* of the slot 42*a* in the passive-lever 42. Thus, the rotation of the latch member 23 is not prevented.

Figure 6:
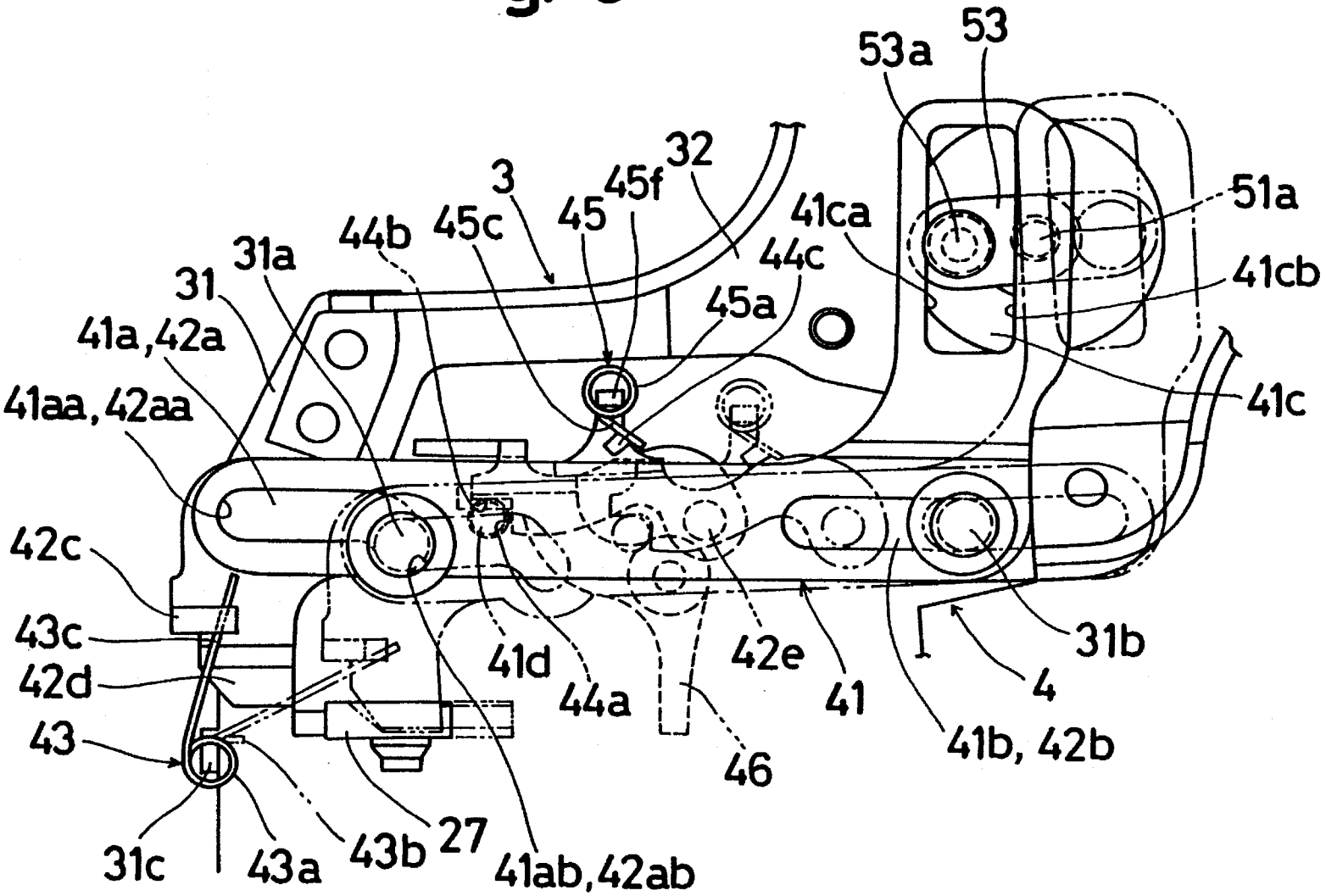
FIG. 6 is a side view of the door closing device shown in FIG. 1 illustrating the operation of the device.

With reference to FIG. 6, immediately upon detection of the half-latched condition of the door by a switch means (not shown), the motor 52 is turned on, thereby rotating the cam-lever 53. As a result of the rotation of the cam-lever 53, the cam-shaft 53*a* contacts and urges the side wall 41*cb* of the slot 41*c* of the active-lever 41, which results in the active-lever, which is in full-line position shown in FIG. 6, being brought into straight-line movement in the rightward direction. In light of the fact that the wall 44*a* of the cancel-lever 44 is under a biasing force of the projection 41*d* of the active-lever 41, the straight-line movement of the active-lever 41 is transmitted via the cancel-lever 44 to the passive-lever 42. As a consequence, the passive-lever 42, which is in the full-line position or its initial position shown in FIG. 6, is brought into straight-line movement in the rightward direction against the torsion spring 43. Such movement of the active-lever 41 (the passive-lever 42) is established along the slots 41*a*, 41*b* (the slots 42*a*, 42*b*).

Figure 10:
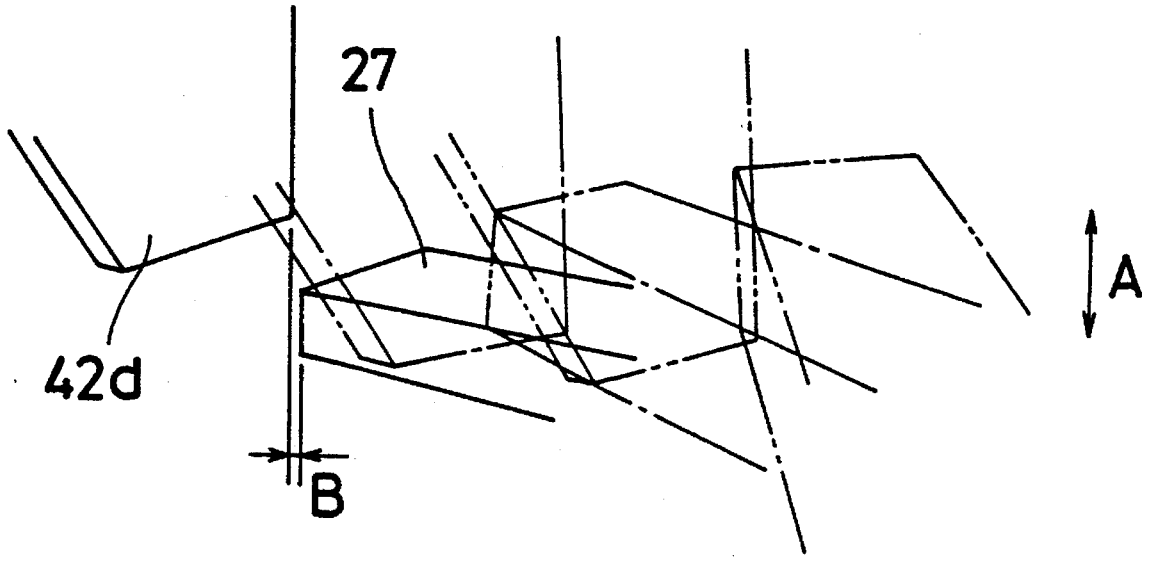
FIG. 10 is an enlarged perspective view of a portion of the device shown in FIG. 1 in which the passive-lever is in engagement with a latch member.

At an initial stage of this movement, the inclined portion 41*ab* (42*ab*) of the slot 41*a* (42*a*) of the active-lever 41 (the passive-lever 42) causes rotation of the active-lever 41 (the passive-lever 42) about the support shaft 31*b*. That is, the active-lever 41 (the passive-lever 42) is moved from its initial position to a lower side portion in FIG. 6 as a result of the guidance provided by the inclined portion 41*ab* (42*ab*) of the slot 41*a* (42*a*). Thereafter, as a result of the guidance provided by the horizontal portion 41*aa* (42*aa*) of the slot 41*a*, the active-lever 41 (the passive-lever 42) is brought into horizontal movement to the two-dotted chain line position or the operating position shown in FIG. 6. The engaging portion 42*d* of the passive-lever 42 is then brought into engagement with the latch-lever 27, thereby rotating the latch member 23. Thus, the latch member 23 is brought into the full-latched condition as shown in the full line position in FIG. 2, and therefore the striker 24 is pulled which represents the full-closed condition of the door. While the latch-lever 27 is being pulled, a sliding movement between the engaging portion 42*d* and the latch-lever 27; is oriented in the direction of A as shown in FIG. 10, which lessens the loss of torque transmission from the engaging portion 42*d* to the latch-lever 27. Thus, less output power of the motor 52 enables the rotation of the latch member 23, which results in smooth operation of the device and miniaturization of the motor 52.

After establishment of the full-latched condition of the latch member 23, the motor 52 continues to move the cam-lever 53 further, which causes the cam shaft 53*a* to be brought into engagement with the side wall 41*ca* of the slot 41*c*. Thus, the active-lever 41 is returned to its original position and the passive-lever 42 is also returned to its original position as a result of the urging force of the torsion spring 43. The engaging portion 42*d* of the passive-lever 42 is offset from the locus of the rotation of the latch-lever 27 (i.e., from the plane of rotation of the latch-lever 27), similar to the offset of the passive-lever 42, during the change of the condition from that shown in FIG. 1 to that shown in FIG. 5. Thereafter, the rotation of the latch member 23 for opening the door, which is established by actuation of the inside door handle or the outside door handle, cannot be disturbed through interference between the latch-lever 27 and the engaging portion 42*d* of the passive-lever 42. It is to be noted that the motor 52 is expected to be turned off automatically after a predetermined time period has elapsed from the detection of the full-latched condition of the latch member 23. If the door is quickly transferred from the opened condition to the full-closed condition without being positioned at the half-closed condition, the half-closed condition of the door is not detected, thereby omitting the operation of the closing mechanism 4.

Figure 7:
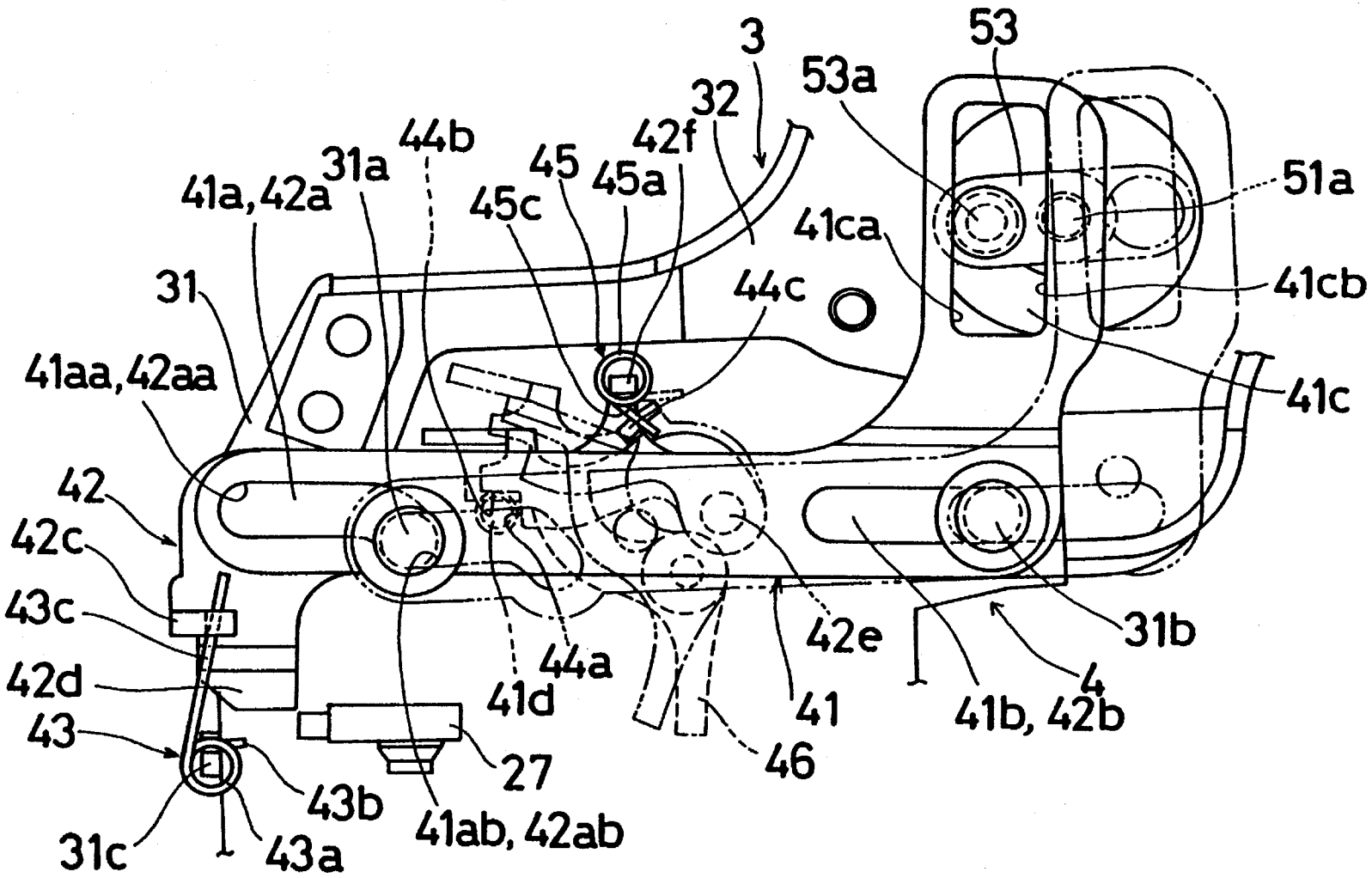
FIG. 7 is another side view of the door closing device shown in FIG. 1 illustrating the operation of the device.

As shown in FIG. 7, when the cancel-lever 44 is rotated in the clockwise direction by the actuation of the inside door handle or the outside door handle during the transfer from the half-latched condition to the full-latched condition of the latch member 23 and when a finger or other object is being held between the door D and the vehicle body B, the projection 41*d* of the active-lever 41 is moved away from both the pressing wall 44*a* and the regulating wall 44*b* of the cancel-lever 44, thereby resulting in the unlocked condition. Thus, the movement of the active-lever 41 is prevented from being transmitted to the passive-lever 42, which results in only the active-lever 41 being brought into the null movement toward the two-dotted line position shown in FIG. 7. As a result, the movement of the passive-lever 42 is interrupted, thereby stopping the rotation of the latch member 23. This means that the movement of the door from the half-latch condition to the full-latch condition is stopped. The passive-lever 41 is returned to its original position by the torsion spring 45. Due to the fact that the open-lever is linked to the pawl 22 and the latch member 23 is released from the pawl 22, the latch member 23 is brought into the unlatched condition.

As mentioned above, the linkage between the active-lever 41 and the passive-lever 42 can be established (interrupted) upon engagement (disengagement) between the projection 41*d* of the active-lever 41 and both the pressing wall 44*a* and the regulating wall 44*b* of the cancel-lever 44 by rotating the cancel-lever 44. In short, the installation of the cancel-lever 44 enables establishment and interruption of the linkage between the active-lever 41 and the passive-lever 42, which results in a simple construction of the closing mechanism 4. Due to the fact that the projection 42*e* and the projection 41*d* are formed on the passive-lever 42 and the active-lever 41, respectively, by pressing (i.e., press-formed), the installation of the cancel-lever 44 can be established merely by providing a gap between the passive-lever 42 and the active-lever 41 which is equivalent to the thickness of the cancel-lever 44. Thus, the thickness of the closing mechanism 4 per se can be reduced in comparison with conventional devices, which assures the installation of the door closing device 1 into a narrow inner space of the door D.

As mentioned above, the interference between the latch-lever 27 and the engaging portion 42*d* can be avoided by offsetting the engaging portion 42*d* from the rotation locus (i.e., the plane of rotation) of the latch-lever 27. At this time, the urging or biasing force of the torsion spring 43 is oriented in the direction of F, whose components F1 and F2 (see FIG. 8) serve for urging the passive-lever 42 in the horizontal and inclined directions, respectively. This structure ensures a reduction in the number of elements or parts, and a smooth return movement of the passive-lever 42 along the slot 41*a*.

Figure 9:
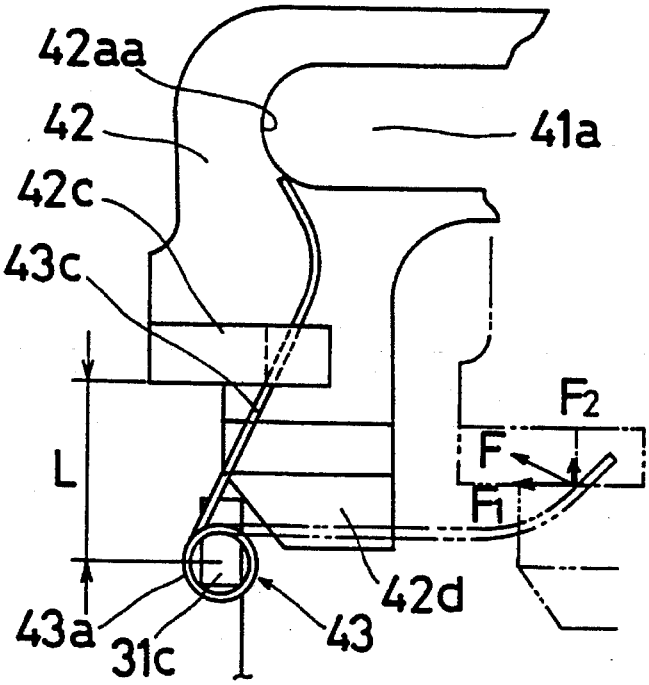
FIG. 9 is an enlarged side view of a portion of the device shown in FIG. 1 illustrating another embodiment of a torsion spring for use in the closing mechanism.

It is to be noted that the torsion spring 43 can be replaced with the one shown in FIG. 9 whose other end 43*c* is bent. Such structure can lessen the span L between the engaging portion 42*c* of the passive-lever 42 and the engaging portion 31*c* of the bracket 31. Moreover, the biasing force of the torsion spring 43 in the horizontal direction can be increased, which enables smooth return movement of the passive-lever 43 even though the movement of the passive-lever 43 from the initial position to the operating position is relatively large.

The principles, preferred embodiments, and modes of operation of the present invention have been described in the foregoing description. The invention which is intended to be protected herein should not, however, be construed as limited to the particular forms disclosed, as these are to be regarded as illustrative rather than restrictive. Variations and changes may be made by those skilled in the art, and equivalents employed, without departing from the spirit of the present invention. Accordingly, the foregoing detailed description should be considered exemplary in nature and not limited to the scope and spirit of the invention as set forth in the appended claims.

What is claimed:

1. A door closing device comprising:

a door-lock mechanism provided adjacent a door and a body, and including a striker secured to the body and a latch member provided on the door, the latch member being secured to a latch lever, the latch lever and the latch member being rotatable together in a first plane;

a driving mechanism; and a door-closing mechanism for establishing a fully closed condition of the door relative to the body when the striker is received in a groove formed in the latch member, the door-closing mechanism including a passive-lever driven by the driving mechanism for being moved in a second plane which is substantially perpendicular to the first plane and for being moved linearly in order to be brought into direct engagement with a lengthwise side of the latch member.

2. A door closing device in accordance with claim 1, wherein the passive-lever is provided with a pair of slots for effecting linear movement of the passive-lever.

3. A door closing device in accordance with claim 2, wherein at least one of said slots includes a horizontal portion and an inclined portion.

4. A door closing device in accordance with claim 1, including a torsion spring operatively associated with the passive-lever for urging the passive-lever towards an initial position.

5. A door closing device comprising:

a door-lock mechanism for being positioned adjacent a door and a body, the door lock mechanism including a latch member positionable on the door and having a groove for receiving a striker secured to the body, the latch member being secured to a latch lever, the latch lever and the latch member being rotatable together in a first plane;

a driving mechanism; and a door-closing mechanism for establishing a fully closed condition of the door relative to the body when the striker is received in the groove formed in the latch member, the door-closing mechanism including a passive-lever driven by the driving mechanism to move the passive-lever from one position in which an engaging portion of the passive-lever is spaced from said first plane for preventing the engaging portion from engaging the latch lever to another position in which the engaging portion of the passive-lever intersects the first plane for permitting the engaging portion to engage the latch lever and move linearly to effect rotation of the latch lever.

6. A door closing device in accordance with claim 5, wherein the door closing mechanism includes an active-lever operatively associated with said passive-lever.

7. A door closing device in accordance with claim 6, wherein said passive-lever and said active-lever each include a slot having a horizontal portion and an inclined portion.

8. A door closing device in accordance with claim 6, wherein the driving mechanism includes an output shaft having a cam lever connected thereto, said active-lever having a slot for receiving the cam lever.

9. A door closing device in accordance with claim 5, wherein the passive-lever includes a slot having a horizontal portion and an inclined portion.

* * * * *